US005480099A

United States Patent [19]

Bunton

[11] Patent Number: 5,480,099

[45] Date of Patent: Jan. 2, 1996

[54] MILL SWEEP FOR PULVERIZERS

[75] Inventor: Joe H. Bunton, Fort Collins, Colo.

[73] Assignee: March-Southwestern Corp., Ft. Collins, Colo.

[21] Appl. No.: 266,004

[22] Filed: Jun. 27, 1994

[51] Int. Cl.[6] ..... B02C 15/00

[52] U.S. Cl. ..... 241/119; 241/24

[58] Field of Search ..... 15/186, 200, 202, 15/207.2; 241/79, 112, 117, 119, 120, 121, 124, 186.2, 222

[56] References Cited

U.S. PATENT DOCUMENTS

| | | | |
|---|---|---|---|
| 38,753 | 6/1863 | Lewis | 241/124 X |
| 888,581 | 5/1908 | Brown | 241/119 |
| 2,100,138 | 11/1937 | Heldt | 15/200 X |
| 3,015,121 | 1/1962 | Ulrich | 15/207.2 X |
| 3,050,763 | 8/1962 | Martin | 15/200 X |
| 3,633,235 | 1/1972 | Draca | 15/200 |
| 4,221,018 | 9/1980 | Hajdu | 15/200 X |
| 4,600,157 | 7/1986 | Willach et al. | 241/119 X |
| 4,888,845 | 12/1989 | Ramm et al. | 15/207.2 X |

FOREIGN PATENT DOCUMENTS

| | | | |
|---|---|---|---|
| 1733085 | 5/1992 | U.S.S.R. | 241/119 |
| 4883 | of 1907 | United Kingdom | 241/124 |

*Primary Examiner*—Timothy V. Eley
*Attorney, Agent, or Firm*—Dean P. Edmundson

[57] ABSTRACT

A brush-type mill sweep which is particularly suited for pyrite removal from the floor of a vertical spindle coal pulverizer. The mill sweep is secured at one end to the spindle or the shaft skirt, and the mill sweep includes a plurality of downwardly-extending cables which are flexible and resilient for removing ungrindable rejects from the floor of the pulverizer beneath the grinding bowl.

10 Claims, 4 Drawing Sheets

MILL SWEEP FOR PULVERIZERS

FIELD OF THE INVENTION

This invention relates to pulverizers and to pyrites scrapers or mill sweeps for use in coal pulverizers. More particularly, this invention relates to mill sweeps for use in vertical spindle coal pulverizers.

BACKGROUND OF THE INVENTION

In conventional vertical spindle pulverizers, coal particles or other raw materials are dropped into a rotating grinding bowl where they are crushed into fine particles by means of multiple rollers. These pulverizers are known as roll-and-race pulverizers. All of the various known pulverizers utilize crushing pressure, impact and attrition between grinding surfaces to reduce materials to a fine particle size. Air is forced upwardly around the periphery of the bowl to lift the particles and carry them away where they are combusted (e.g., in a power plant boiler). In the so-called bowl mill, the grinding rolls are stationary and the bowl rotates. The pulverized product, such as pulverized coal, is fluidized and transported via air through the pulverizer outlet and is pneumatically conveyed through pipes to a boiler, for example.

Inevitably, there are a number of ungrindable objects (e.g., rocks, shale, iron pyrites, tramp iron, etc.) which are too heavy to be fluidized by the transport air. The reject material, therefore, is pushed over the edge of the bowl and falls into the air inlet section of the mill, underneath the grinding bowl. The reject material must be removed continuously from the underbowl area to prevent excessive build-up and potential fires and/or explosions. The current device employed for removal of reject material is attached to and rotates with the bowl hub or skirt near the floor of the mill. The so-called plow or scraper is typically very heavy, difficult to maintain, and expensive. In some cases, it is also unreliable and can even damage the mill floor. The plow or scraper rotates in a horizontal plane and scrapes the rejects off of the mill floor and down an opening into a reject chute, where the rejects are collected in a hopper and then they are disposed.

There has not heretofore been provided a mill sweep device having the advantages provided by the present invention.

SUMMARY OF THE INVENTION

In accordance with the present invention there is provided a brush-type mill sweep which is detachably secured to the shaft skirt near the floor of a coal pulverizer. The mill sweep eliminates the problems associated with the traditional rejects plow or scraper. The mill sweep is light in weight, easy to install and maintain, inexpensive, reliable and is non-detrimental to other pulverizer components.

The brush elements of the mill sweep of the invention are held in place in a rotating frame or bracket secured to the shaft skirt just above the mill floor in the pulverizer underbowl area. The bracket rotates with the mill bowl hub or skirt to which it is attached. The brush elements effectively sweep any rejects, such as coal pyrites, from the mill underbowl area to the opening to the reject chute. The brush elements are easily removed and replaced, if necessary.

Other advantages of the mill sweep of the present invention will be apparent from the following detailed description and the accompanying drawings.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
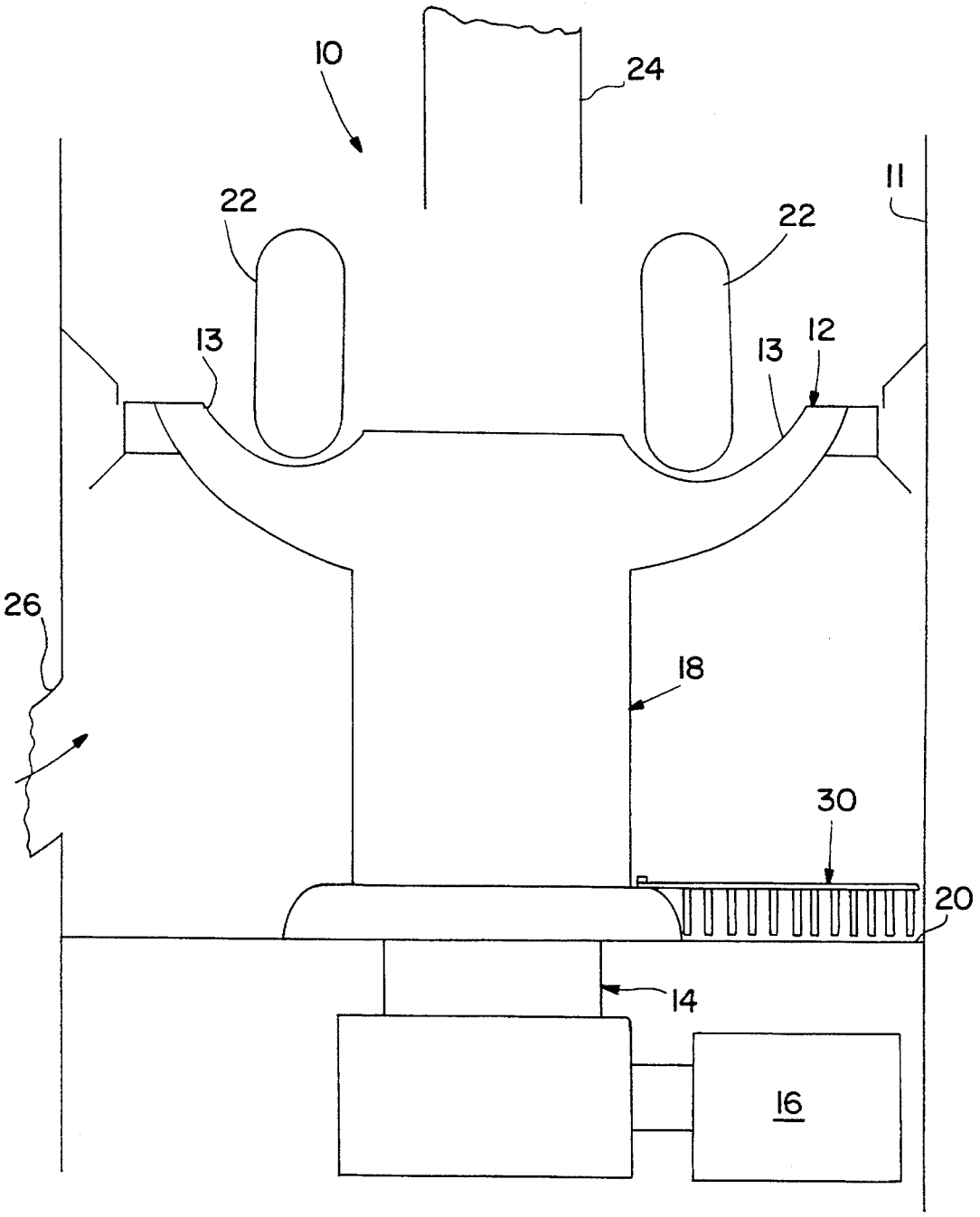
FIG. 1 is an elevational, cutaway view of pulverizer apparatus employing the mill sweep of this invention.
Figure 2:
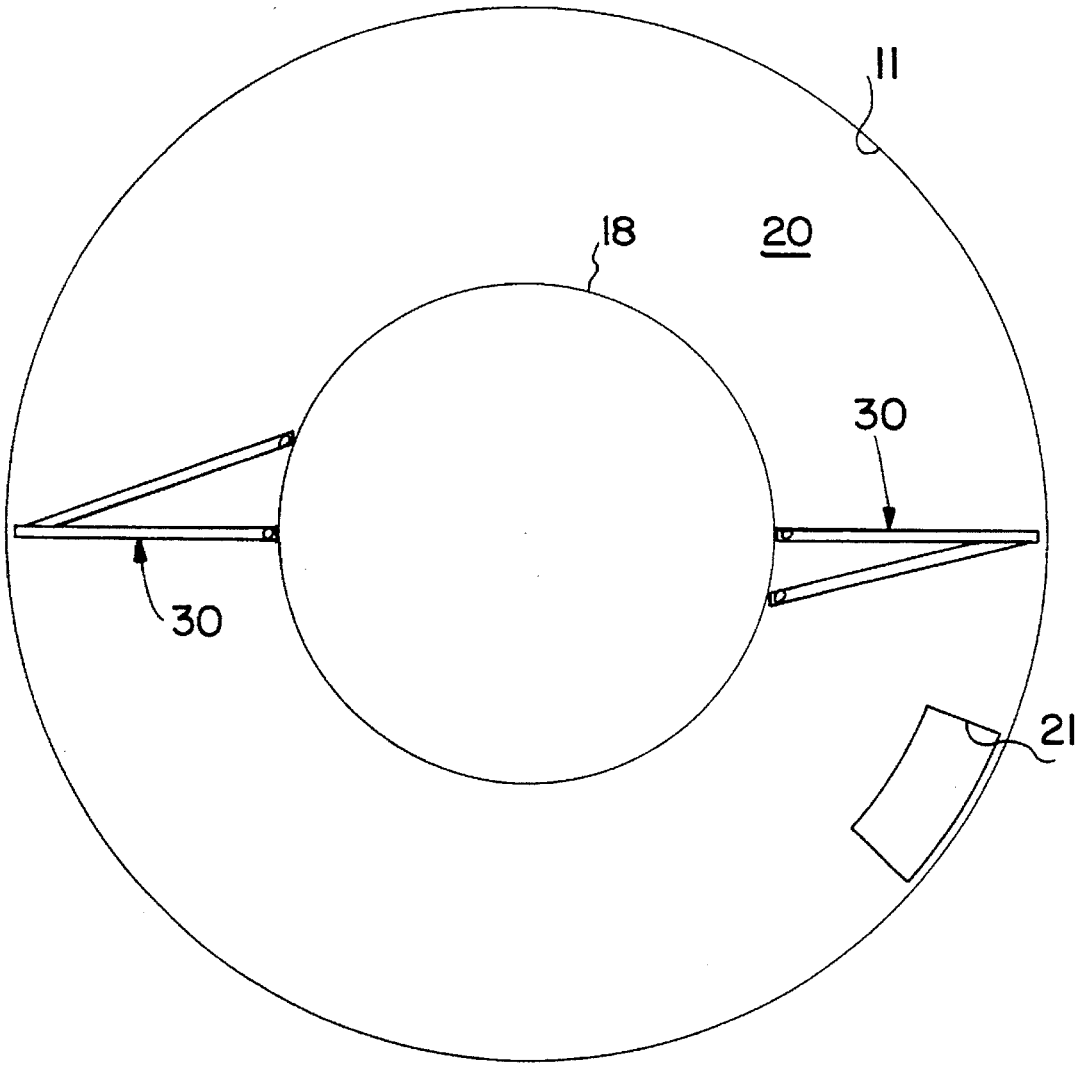
FIG. 2 is a top view of the apparatus of FIG. 1.

In the drawings there is shown a vertical spindle pulverizer 10 having a rotating grinding bowl 12 and a vertical spindle or shaft 14 powered by a motor 16. A shaft skirt 18 encloses the vertical spindle. A horizontal floor 20 is located at the base of the spindle, as shown.

The bowl includes an annular race 13 in which multiple rollers 22 are positioned. Coal or other raw material is fed to the bowl through a chute 24, for example, and the material is pulverized by crushing pressure applied to it by the rollers in the race.

At the outer periphery of the bowl there are vanes through which an airstream passes after entering the mill through inlet 26. The moving air (indicated by the arrow) lifts the finely-ground coal or other material and carries them to a power plant boiler, for example. Heavy particles, such as pyrites, rocks, etc. pass over the edge of the bowl and drop to the floor 20.

Secured to the periphery of the shaft skirt 18 near the floor 20 are a plurality of brush-type mill sweeps 30. For example, there may be two, three, four, or more of the mill sweeps which are preferably equidistantly spaced and which are secured at their inner ends to the shaft skirt. The outer end of each mill sweep 30 extends to a point near the wall 11 of the mill housing. An opening 21 is located in the floor 20 for receiving the reject material from the bowl 12. Although only one mill sweep 30 is shown in FIG. 1, preferably there will be at least two such mill sweeps in the mill.

Figure 3:
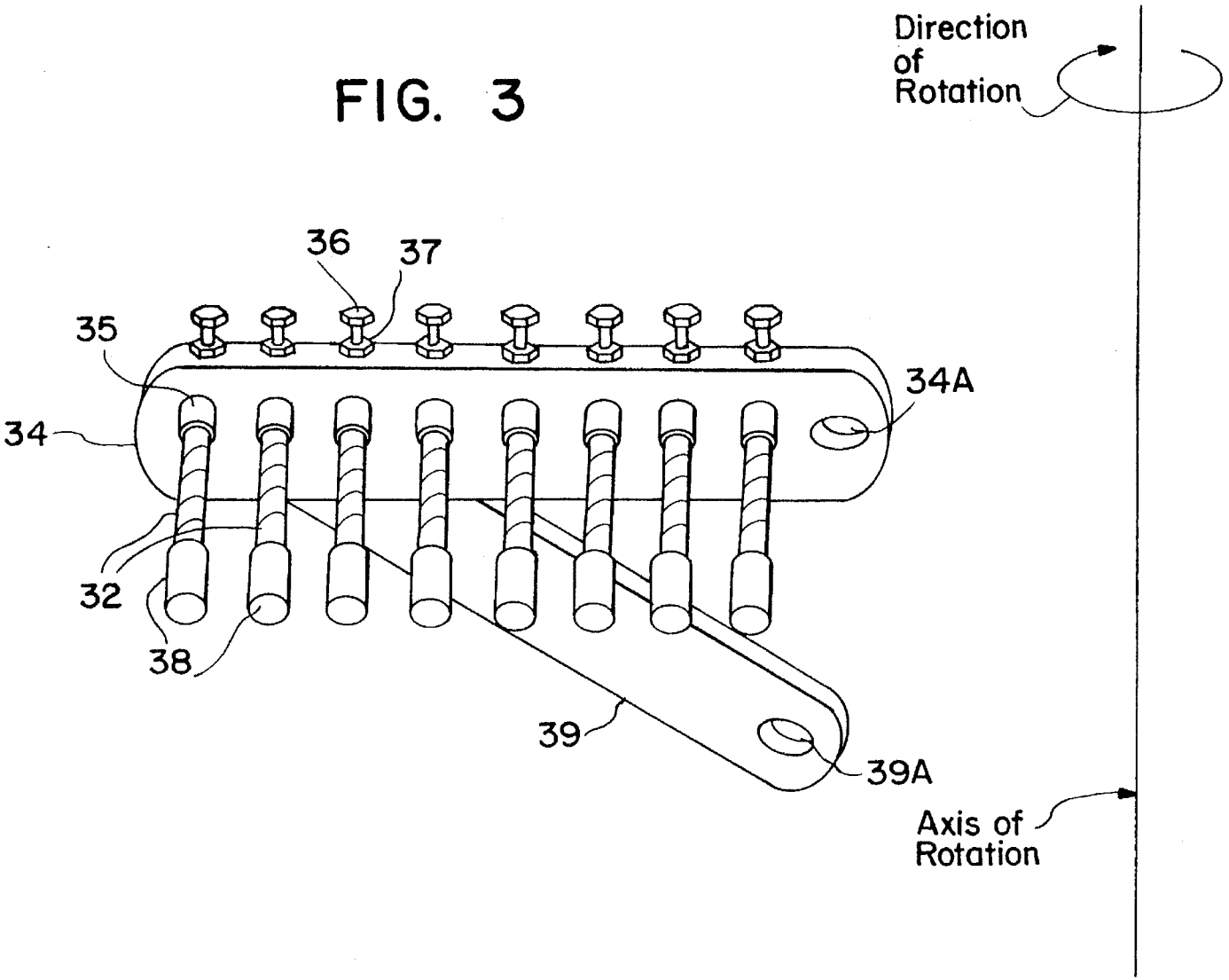
FIG. 3 shows one embodiment of mill sweep of the invention.

One embodiment of mill sweep 30 of the invention is shown in FIG. 3 comprising a plurality of downwardly-extending flexible steel cables 32 attached at their upper ends in appropriate openings in mounting frame or bar 34. A sleeve 35 is secured to the upper end of each cable, and a threaded bolt 36 is tightened against the sleeve 35 to firmly secure each cable to the bar 34. Each bolt 36 is threadably received in a threaded aperture in bar 34. A lock nut 37 on bolt 36 can be tightened to lock the bolt 36. Preferably the lower end of each cable includes a metal cap 38 to extend the wear life of the cable. It is also preferable for the bolts 36 and lock nuts 37 to be located on the trailing edge of the sweep bar. It is also preferable to include a tramp bar 39 to protect the mill sweep from large metal objects. The inner end of bar 34 and tramp bar 39 include apertures 34A and 39A for bolting the mill sweep to the shaft skirt.

By loosening bolt 36, the cable 32 can be vertically adjusted so that its lower end can be properly positioned near the floor of the mill. Then the bolt can be tightened again. It is also possible to easily replace any of the cables 32 if that should ever be necessary, without having to replace the entire mill sweep. Preferably the cables are parallel to each other.

The diameter of the cables may vary, as desired, from about 0.5 to 1 inch. A diameter of about 0.75 inch is preferred. This provides a cable which is flexible but yet is sufficiently stiff to move reject material along the floor of the mill to the opening 21. The length of each cable is preferably about 9 to 14 inches, although shorter cables could be used.

The spacing between adjacent cables may also vary, for example, from about 1.5 times the cable diameter to 3 times the diameter. Multiple rows of cables may be used on each sweep, if desired. Staggered cables may also be used.

Figure 4:
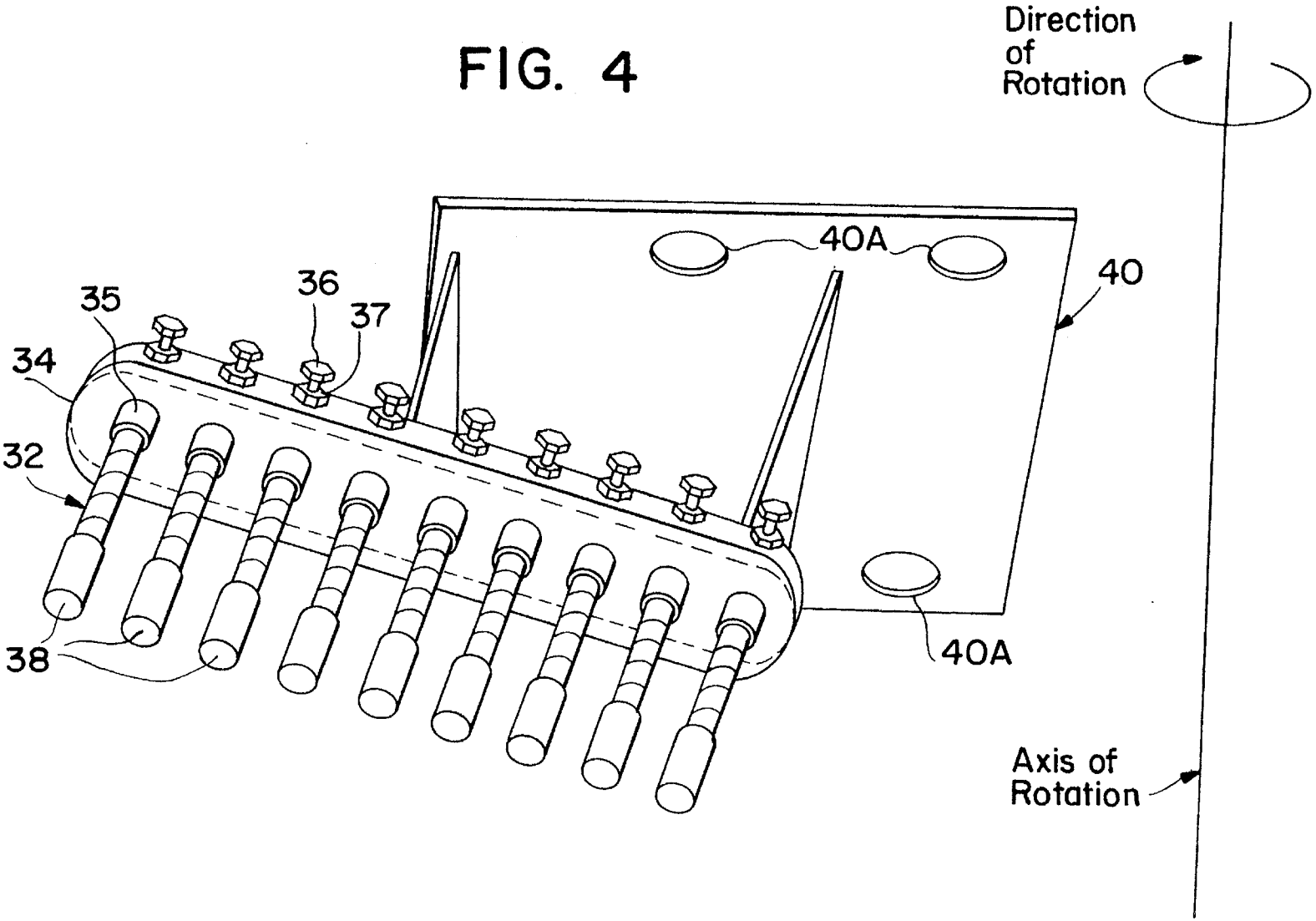
FIG. 4 shows another embodiment of mill sweep of the invention.

Another embodiment of mounting bracket 40 for the brush sweep is shown in FIG. 4. This embodiment includes apertures 40A for mounting the mill sweep to other types of shaft skirts in pulverizers. Other types of mounting brackets may also be used to mount the mill sweep to any style of shaft skirt in a pulverizer.

The brush-type mill sweep of this invention effectively removes rejects, such as pyrites, from pulverizers. Tests have shown that the invention is equally effective or better at removing pyrites than the traditional pyrite scraper. In addition, the mill sweep of this invention is much lighter in weight, easier to install and maintain, more economical, more reliable, and less detrimental to other pulverizer components than the traditional pyrites plow.

Other variants are possible without departing from the scope of this invention.

What is claimed is:

1. In a pulverizer mill of the type including a rotatable vertical spindle, a floor member, and an opening in the floor member, wherein the improvement comprises a mill sweep member carried by said vertical spindle, wherein said mill sweep member comprises:

(a) a horizontal, elongated mounting bar including a plurality of spaced openings;

(b) a plurality of cable members each having a first end detachably secured to said mounting bar and a free end; wherein said first end is secured in a sleeve member which is received in one of said openings in said mounting bar; wherein each said sleeve member is vertically adjustable relative to said mounting bar; and wherein each said free end extends below said mounting bar.

2. The improvement in accordance with claim 1, wherein each said sleeve member is secured to said mounting bar by means of a bolt.

3. The improvement in accordance with claim 2, wherein said bolt is threadably received in a threaded aperture in said mounting bar.

4. The improvement in accordance with claim 3, wherein said bolt is perpendicular to said sleeve member.

5. The improvement in accordance with claim 1, wherein said free end of each cable member includes a metal cap.

6. The improvement in accordance with claim 1, wherein the diameter of each said cable member is in the range of 0.5 to 1 inch.

7. The improvement in accordance with claim 1, wherein said mill further includes a shaft skirt, and wherein said mounting bar is secured to said shaft skirt.

8. The improvement in accordance with claim 7, wherein said mounting bar includes inner and outer ends; wherein said inner end is secured to said shaft skirt.

9. The improvement in accordance with claim 8, further comprising a tramp bar secured between said shaft skirt and said outer end of said mounting bar.

10. The improvement in accordance with claim 1, wherein the length of each cable member is in the range of 9 to 14 inches.

* * * * *